United States Patent [19]

Seeley

[11] 3,967,224

[45] June 29, 1976

[54] COATED MAGNETICALLY BIASED REED SWITCH

[75] Inventor: Robert L. Seeley, San Diego, Calif.

[73] Assignee: The United States of America as represented by the Secretary of the Navy, Washington, D.C.

[22] Filed: Apr. 25, 1975

[21] Appl. No.: 571,658

[52] U.S. Cl. ..... 335/151; 335/153

[51] Int. Cl.[2] ..... H01H 1/66

[58] Field of Search ..... 335/151, 153

[56] References Cited

UNITED STATES PATENTS

| | | | |
|---|---|---|---|
| 3,382,468 | 5/1968 | Mattes | 335/153 |
| 3,707,690 | 12/1972 | Sakatos | 335/153 |

FOREIGN PATENTS OR APPLICATIONS

| | | | |
|---|---|---|---|
| 1,083,980 | 9/1967 | United Kingdom | 335/153 |
| 1,142,055 | 2/1969 | United Kingdom | 335/153 |

*Primary Examiner*—George Harris

*Attorney, Agent, or Firm*—Richard S. Sciascia; Ervin F. Johnston; Thomas Glenn Keough

[57] ABSTRACT

A small reed switch having a glass tubularly shaped envelope containing a pair of reed contacts is modified to ensure its being biased to either an open or a closed position. A donut-shaped piece of a rubber-bonded, barium-ferrite, magnetic material is circumferentially mounted on the reed switch at a position where its magnetic field influences the contacts to an open position or a closed position. Thusly arranged, an actuating magnet, having a sufficient field at a single pre-established distance from the contacts, actuates the switch from all radial directions from the switch. Potting the modified switch in an epoxy resin further ensures a greater reliability and makes it ideal for implantations in laboratory animals.

1 Claim, 5 Drawing Figures

COATED MAGNETICALLY BIASED REED SWITCH

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Dry reed switches long have been used as proximity switches to be responsively actuated by a nearby magnetic field. Biomedical researchers, in particular, need a switch that is reliably turned on and off to actuate implanted sensors or stimulators of a variety of physiological phenomena. Magnetically biased switches, that is, those biased by small pieces of metal magnets, have been used yet their reliability leaves much to be desired. To elaborate, a state of the art reed switch which carries a single small metal chip for biasing purposes reacts differently to an external actuating magnet approaching the reed switch from different directions. When the metal chip is oriented facing the external magnet, the separation between the chip and the magnet can be relatively large since only a small magnetic field is needed to actuate the switch. When the metal magnet chip is in a diametrically opposed location behind the reed switch, a greater magnetic field is needed to actuate the switch and the actuating magnet must be brought closer to the switch or a stronger external field is required. Consequently, to assure consistent results, researchers would bring a large actuating magnet too close to the reed switch to ensure the actuation of the switch. After a number of switching sequences the overly strong magnetic field of the actuating magnet tended to depolarize or repolarize the small metal chip. This changing of the small metal magnet's field renders the switch useless and surgery must be resorted to to replace the defective switch. Recovery from the surgical operation would waste time that would otherwise have been used in collecting data. Thus, there is a continuing need in the state of the art for a highly reliable small reed switch which is actuated uniformly by an externally applied magnetic field.

SUMMARY OF THE INVENTION

The present invention is directed to providing an improvement for a switch magnetically actuated by an external field. The switch has a tubular glass envelope containing a pair of reed contacts. A donut-shaped piece of rubber-bonded, barium-ferrite magnetic material is snugly fitted about the tubular glass envelope so that its magnetic field biases the reed contacts to a predetermined position. Being so arranged, an actuating external magnetic field of a preset magnitude actuates the switch irrespectively of the radial location of the external field with respect to the switch.

It is a prime object of the invention to provide a magnetically actuated reed switch of higher reliability.

Another object of the invention is to provide a switch which is actuated by external magnetic field of a given magnitude irrespective of the radial direction of the external field from the switch.

Another object is to provide a switch which ensures long time operation due to its being encased in a protective coating.

Yet another object of the invention is to provide a highly reliable switch which is relatively inexpensive.

These and other objects of the invention will become more readily apparent from the ensuing specification when taken with the drawings.

DESCRIPTION OF THE PREFERRED EMBODIMENT

Figures 1A, 1B:
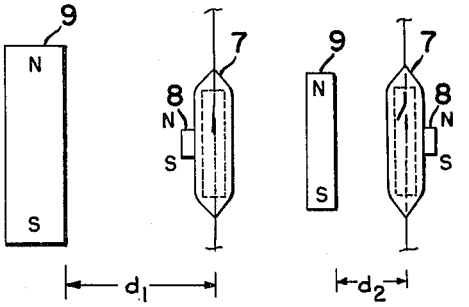
FIG. 1a FIG. 1b (PRIOR ART)
FIGS. 1*a* and 1*b* depict the problem of the prior art overcome by the present invention.

Looking to FIGS. 1*a* and 1*b* of the drawings, a conventional, state of the art, reed switch 7 is shown mounting on it a small metal magnet chip 8. The switch includes a glass envelope filled with an inert gas and containing two reed contacts. The contacts are shown biased by the magnetic field exerted by the metal magnet chip, such that a complimentary externally applied magnetic field will bistably actuate the switch.

The reed contacts are switched by an induced magnetism created in the contacts by a magnetic field eminating from an actuating magnet 9. When the field of the actuating magnet is reversed, the reed contacts open. Yet, however, this conventional, uncomplicated design has shortcomings.

The first shortcoming is the difficulty of properly positioning the metal chip on the glass envelope. The loose square chip and round glass envelope are differently configured and hard to mate. Once the proper orientation has been determined by trial and error to bias the contacts, the chip must be glued in place. The chip must be held in place while the glue dries. This is overly time consuming.

The second shortcoming concerns reliability. When the switch and magnet chip are oriented facing an actuating magnet 9, as depicted in FIG. 1*a*, the distance $d_1$, at which the contacts are opened, is a given separation from the actuating magnet. On the other hand, if the chip is located on the opposite side of the reed switch with respect to the actuating magnet, see FIG. 1*b*, the distance, $d_2$, between the switch and the actuating magnet is much less than $d_1$. Thus, since the distance at which the switch is actuated depends on the location of the external field, unreliable switching can occur.

Another problem is that bringing the actuating magnet too close, impresses an excessively strong magnetic field upon the chip and switch. The hazard of subjecting the chip to such an excessively strong field is that it may become depolarized or repolarized in the opposite direction. When this happens, of course, the small switch fails to maintain predetermined bistable activity. If the switch is embedded or implanted in the living tissue of an animal for physiological monitoring, testing or stimulation, it must be removed and replaced surgically.

Figure 2:
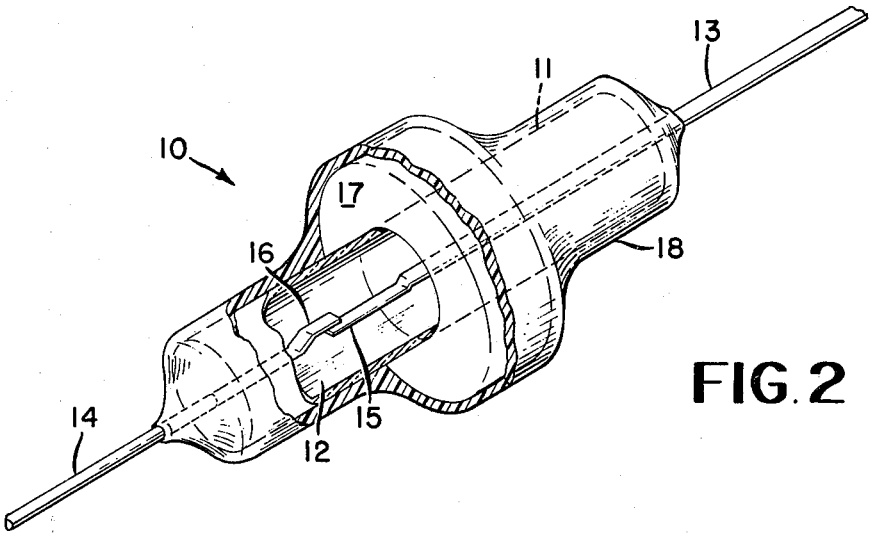
FIG. 2 is a side view of the invention.
Figure 3:
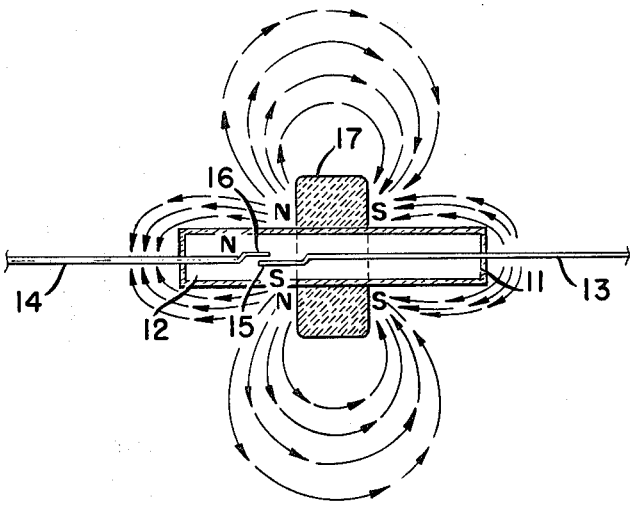
FIG. 3 is a cross-sectional side view of the invention, depicting the magnetic fields.
Figure 4:
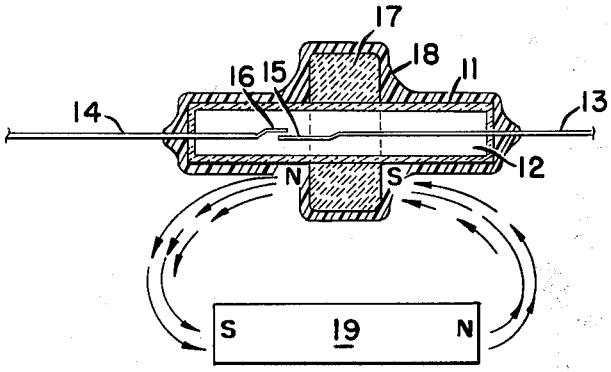
FIG. 4 shows the actuation of the switch by an external magnetic field.

Although the invention as set out in FIGS. 2, 3, and 4 evolved to avoid the wasted time of unnecessary surgery, it lends itself to a number of applications where high reliability is called for. The improved, highly reliable switch 10 includes the components of a conventional reed switch. A tubular glass envelope 11 encloses a chamber 12 filled with an inert gas. A pair of leads 13 and 14 come in at opposite ends of the envelope and terminate in a pair of contacts 15 and 16, usually preset in the open position.

The improvement to the aforedescribed conventional switch is the inclusion of a donut-shaped piece 17 of a rubber-bonded, barium-ferrite magnetic material. Such a material is commercially marketed by the 3M Company of St. Paul, Minnesota, under the trade designation "Plastiform Magnet Material BX-1013". This material has a high resistance to demagnetization and it is available in flexible strips that are easily cut drilled and otherwise tailored.

In this invention, donut-shaped piece 17 has a hole which snugly fits on the outer surface of the glass envelope. Thusly arranged, its biasing magnetic field, schematically set forth in FIG. 3, uniformly and circumferentially biases contacts 15 and 16 to have a bistable capability. The biasing field envelopes all sides of the switch substantially uniformly.

Care must be taken to position donut 17 along the glass envelope so that the contacts remain closed after a complimentary actuation field has been impressed and open after an oppositely oriented actuation field has been applied. The snugly fitting donut permits easy readjustment along the glass envelope to allow an uncomplicated creation of a multilevel threshold bistable capability. Once the donut has been properly positioned, the donut is securely held in place by potting it in an epoxy 18 to provide a protective coating after curing.

In operation, an actuating magnet 19 is brought near improved switch 10. The actuating magnetic field opens or closes the contacts of the switch depending on the polarity of the actuating field. While FIG. 4 shows the actuating magnet 19 located at a distance below the switch, it could be moved to any position radially surrounding tubular glass envelope 11 and spaced the same distance to reliably effect the same actuation. The contacts are reclosed by reversing the polarity of the actuating magnet with respect to the switch.

The magnetic field for actuating the switch is of the same magnitude, irrespective of the radial orientation of the actuating magnet with the switch. The positioning of the actuating magnetic field can be said to be capable of being omniradial with respect to tubular glass envelope 11. The distance at which actuation occurs is the same using the same actuation magnet.

The possibility of damaging the switch by using too strong of an actuating magnet or by bringing the actuating magnet too close is virtually eliminated. The suitable actuating magnet is predeterminable and the distance is preknown. Since there are no variables to bear in mind, the likelihood of human error is reduced.

Obviously, many modifications and variations are possible in the light of the above teachings, and, it is therefore understood that the invention may be practiced otherwise than as specifically described.

What is claimed is:

1. In a switch magnetically actuated by an external magnetic field having a tubular glass envelope containing a pair of longitudinally extending reed contacts, an improvement therefor is provided comprising:

a donut-shaped piece of rubber-bonded barium-ferrite magnetic material having a lateral hole sized to snugly fit about the tubular glass envelope to easily facilitate its positioning and mounting on the envelope mounted to encompass the circumference of the tubular glass envelope for magnetically biasing the reed contacts radially to a predetermined position, the circumferential mounting being mandatory to ensure reliable actuation of the switch by an omniradially disposed external magnetic field and a cured epoxy coating completely covering said switch and donut-shaped piece of rubber bonded barium-ferrite material to further insure greater reliability.

* * * * *